US007074303B2

(12) United States Patent
Porter

(10) Patent No.: US 7,074,303 B2
(45) Date of Patent: Jul. 11, 2006

(54) BLANKET CLAMPING ARRANGEMENT FOR SHOE PRESS OF PAPERMAKING MACHINE

(75) Inventor: Mark Anthony Porter, Chorley (GB)

(73) Assignee: Sandusky Techologies Limited, Edinburgh (GB)

( * ) Notice: Subject to any disclaimer, the term of this patent is extended or adjusted under 35 U.S.C. 154(b) by 516 days.

(21) Appl. No.: 10/252,619

(22) Filed: Sep. 23, 2002

(65) Prior Publication Data

US 2003/0168195 A1 Sep. 11, 2003

(30) Foreign Application Priority Data

Mar. 8, 2002 (GB) ..... 0205493.0

(51) Int. Cl.
*D21F 3/04* (2006.01)

(52) U.S. Cl. ..... 162/358.3; 162/272; 100/153

(58) Field of Classification Search ..... 162/199, 162/204–207, 273, 274, 358.1, 358.3, 272, 162/361; 100/37, 153; 492/7, 20, 45
See application file for complete search history.

(56) References Cited

U.S. PATENT DOCUMENTS 5,098,523 A * 3/1992 Ilmarinen et al. ..... 162/358.3
5,141,601 A 8/1992 Karlsson et al.
5,496,442 A * 3/1996 Laapotti ..... 162/199
5,556,514 A * 9/1996 Didier ..... 162/358.3
5,700,357 A * 12/1997 Didier ..... 162/358.3
2004/0014572 A1* 1/2004 Fujiwara et al. ..... 492/45
2004/0060460 A1* 4/2004 Tonello ..... 100/156
2004/0173275 A1* 9/2004 Matuschczyk et al. .. 139/383 A

FOREIGN PATENT DOCUMENTS

DE 29702362 U1 2/1997
EP 0442257 B1 8/1991
WO WO 98/16686 4/1998

* cited by examiner

*Primary Examiner*—Eric Hug
(74) *Attorney, Agent, or Firm*—MacMillan, Sobanski & Todd, LLC.

(57) ABSTRACT

A shoe press for a papermaking machine having clamping means mounted onto the head from the end thereof remote from the blanket. In one embodiment, the head itself is provided with a wedge surface in engagement with respective inclined surfaces of wedge segments and the blanket extends between these wedge segments and opposing surfaces provided on the clamping means. Axial displacement of the clamping means relative to the head, e.g. by tightening or releasing of bolts, then causes the blanket to be clamped between the wedge segments and the clamping means or to be released and removable therefrom. In another embodiment, it is the clamping means which is provided with wedge surfaces in engagement with respective inclined surfaces of wedge segments, and the blanket then extends between the wedge segments, and an opposing flat surface on the head. However, in other respects axial displacement of the clamping means brings about clamping or release of the blanket edge in the same manner.

15 Claims, 3 Drawing Sheets

BLANKET CLAMPING ARRANGEMENT FOR SHOE PRESS OF PAPERMAKING MACHINE

BACKGROUND OF THE INVENTION

This invention concerns a shoe press for a papermaking machine, and more specifically an arrangement for clamping a blanket (sometimes referred to in the art as "a jacket") thereon.

A shoe press employs a backing roll and an elongated shoe which has a concave surface which matches the convex surface of the backing roll and cooperates with the roll over a length of the order of 25 cm along the direction of travel of the paper web. This extended nip length is desirable to increase the time during which the paper web is subject to pressure to allow more water to pass from the web into a felt on which it is supported, or respective felts between which it is sandwiched. The shoe, which forms one-half of the nip, is stationary. Without further modification, a paper web passing through the nip formed between the shoe and the backing roll would experience unacceptable rubbing on the non-moving shoe. To overcome this problem, a bearing blanket in the form of a cylindrical tube is slidably disposed over the shoe and around the support shaft on which the shoe is mounted. Friction between the bearing blanket and the shoe is greatly reduced due to the presence of an oil film supplied between the shoe and the inside of the blanket. The backing roll, the paper web and the felt on which it is supported are frictionally engaged and in turn engage the upper surface of the bearing blanket, causing it to slide over the shoe and to rotate about the shoe and its support shaft.

On one type of shoe press the cylindrical bearing blanket is open-ended, but this causes a problem with oil contamination of the web and of surrounding equipment as there is a tendency for lubricating oil disposed between the shoe and the blanket to creep around the edges of the blanket. The solution has been to seal the ends of the blanket to two rotating heads which are mounted on the shoe support shaft.

The cross-section of the blanket at the heads is circular, but the cross-section taken through the nip between the shoe and the backing roll has an appearance somewhat similar to an apple in cross-section (see FIG. 1). Thus, as the blanket moves through the nip, it is elastically deformed. Between the ends of the nip and the ends of the blanket, the material of the blanket forms a compound curve as the blanket transits from the shape of the nip to the circular ends of the blanket where they are attached to the rotating head assemblies. This results in wear on the blanket and it must therefore, be periodically replaced.

A typical papermaking machine of which such a shoe press forms a part may produce over 50,000 $m^2$ of paper an hour. Thus, downtime is costly and the method of clamping the blanket to the rotating head assemblies must be compatible with rapid and precise replacement of the blanket.

Prior art clamping arrangements have been described in U.S. Pat. Nos. 5,700,357, 5,141,601 and 5,098,523. These include a plurality of wedge segments arranged radially outwards of the head and each having an inclined surface; and clamping means mounted onto the head for axial displacement relative thereto so as to cause radial displacement of the wedge segments relative to the head. Portions of the blanket extend between the wedge segments and opposing surface means and are clamped therebetween upon radial displacement of the wedge segments.

SUMMARY OF THE INVENTION

The invention provides a blanket clamping arrangement as described above but characterized in that the clamping means is mounted onto the head from the end thereof remote from the blanket, in that either the head itself or the or each clamping means is provided with a wedge surface in engagement with respective inclined surfaces of the wedge segments, and in that the blanket extends between the wedge segments and opposing surface means provided either on the clamping means or on the head, respectively, so that axial displacement of the clamping means relative to the head causes the blanket selectively to be clamped between the wedge segments and either the clamping means or the head respectively, or to be released and removable therefrom.

An object of the invention is to provide an improved clamping arrangement, specifically wherein the components effecting the clamping are fitted from outside the blanket and can readily be released and reattached.

A further object is to provide a simpler arrangement requiring fewer components than hitherto.

Yet a further object is to provide an arrangement which can seal the blanket to the head or heads as well as merely clamping it thereto.

Other objects and advantages of the present invention will become apparent to those skilled in the art upon a review of the following detailed description of the preferred embodiments and the accompanying drawings.

DETAILED DESCRIPTION OF THE PREFERRED EMBODIMENTS

Figure 1:
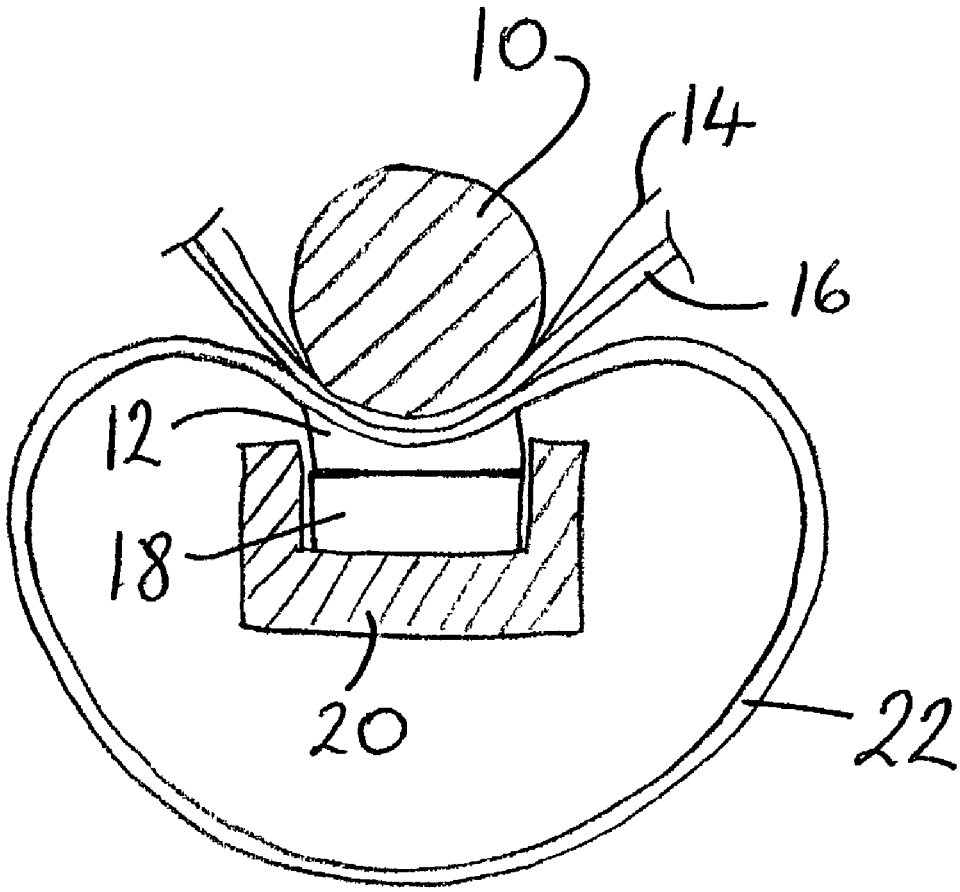
FIG. 1 is a schematic sectional view of a conventional shoe press.

FIG. 1 illustrates a shoe press of conventional form wherein a backing roll 10, mounted to a press frame (not shown) is opposed to a shoe 12. The shoe 12 has a concave surface which conforms to the cylindrical surface of the roll 10 and provides an extended nip therebetween. As previously mentioned an extended nip is advantageous to speed high pressure water removal in paper making machinery. A paper web 14 supported upon a felt 16 passes through the nip. The shoe 12 is urged towards the backing roll 10 by one or more pistons 18, mounted on a stationary support beam 20.

A blanket 22 in the form of a seamless tube is mounted over the shoe 12, between said shoe and the paper web supported on the felt 16. Throughout the length of the shoe 12, the blanket 22 has a dimpled configuration, as shown in FIG. 1, but at its end margins, outwards of the shoe 12, it resumes a cylindrical configuration.

The blanket 22 extends between and is mounted at its respective ends to the rotatable outer portions (usually termed outer heads) of respective front and back heads. The outer heads in the shoe press of the invention are preferably provided as continuous rings. In FIGS. 2 to 7 only a small part-annular portion of one outer head 24 is shown, in each case, together with only a small, part-cylindrical portion of the end margin of the blanket 22.

The outer head 24 in all of FIGS. 2 to 7 of the drawings is mounted on a bearing (not shown) to allow rotation of the blanket 22.

The inner surface of the blanket 22 is, in use, lubricated with oil to reduce friction as it passes at high speed (in the region of 15 m/sec) over the shoe 12. To prevent escape of oil it is preferable for the blanket 22 to be sealingly connected to the respective heads. This is possible using, the clamping arrangement of the invention. However, the clamping arrangement of the invention may be used solely for connection to one or each head with addition sealing means also being provided.

Figure 2:
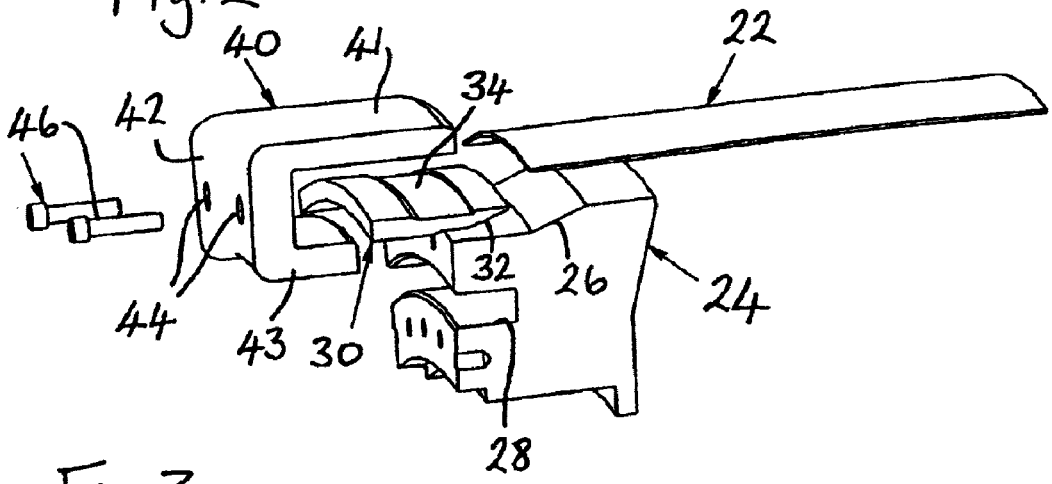
FIG. 2 is a schematic exploded perspective view of one part of a first embodiment of a blanket clamping arrangement for a shoe press in accordance with the present invention.
Figure 3:
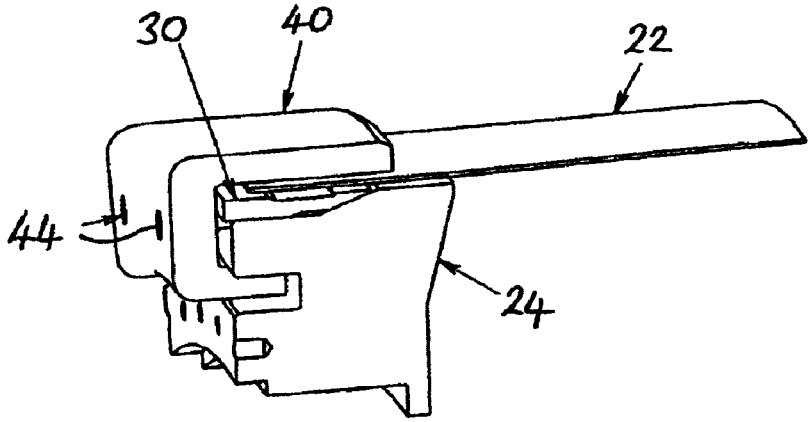
FIG. 3 is a similar view showing the components of FIG. 2 when fitted together.
Figure 4:
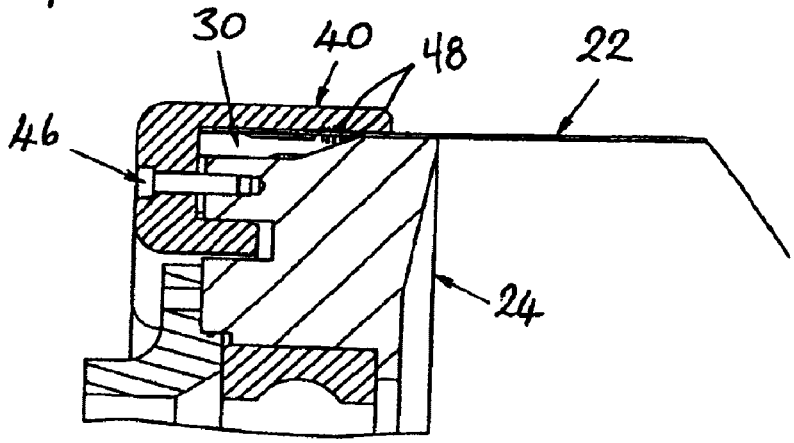
FIG. 4 is a fragmentary cross sectional view of the arrangement of FIGS. 2 and 3.

With reference to FIGS. 2 to 4 of the drawings, a first preferred practical embodiment of the blanket clamping arrangement of the invention additionally comprises six part-annular wedge segments or inner clamps 30, only one of which is shown, and clamping means in the form of twelve part-annular or segmental outer clamps 40.

In this embodiment the outer surface of the head 24 is formed with a tapered frustoconical portion 26 and the end surface of the head 24 remote from the blanket 22 is provided with a circular groove 28. The wedge segments 30 directly overlie the outer surface of the head 24 and are of a size to abut each other circumferentially to form a complete ring encircling the head 24. Each wedge segment 30 has an inclined surface portion 32 on its inner surface to mate up with the frustoconical portion 26 of the head 24. Also, in its outer surface each wedge segment 30 has a shallow recess 34 to facilitate release of the blanket 22 when the latter needs replacement.

The twelve outer clamps 40 are also each of a size to abut each other circumferentially and together provide a complete ring. Alternate clamps 40 in this arrangement are mounted, respectively, so as to completely overlie a central portion of one wedge segment 30 and so as to overlie symmetrically the joint between adjacent wedge segments 30. Also, each is mounted onto the head 24 by means of two bolts 46, as shown. The outer clamps 40 are generally V-shaped in section having an outer limb 41, a central web 42, and an inner limb 43. In use the outer limb 41 extends radially outwards of the wedge segments 30 and clamps the blanket 22 therebetween. The central web 42 extends axially outwards of the wedge segments 30 and the head 24 and has apertures 44 through which the bolts 46 extend to connect the outer clamp 40 to the head 24. The inner limb 43 projects into the groove 28 and thereby locates the outer clamp 40 relative to the head 24.

In use, because the blanket 22 is a seamless tube and relatively inflexible, and because the heads are not readily demountable from the press frame and have only a limited range of axial adjustment, the blanket 22 has to be installed by passing it over one of the heads.

Thus, with reference to FIGS. 2 to 4, with the wedge segments 30 and the outer clamps 40 removed, the blanket 22 is passed over the front head and positioned relative to the back head as shown. The front head is preferably of exactly the same configuration as the back head. The taper portion 26 on the front head facilitates feeding the blanket 22 thereover.

The wedge segments 30 are then positioned as shown, from outside the blanket loop, fitting over the taper portion 26 of the head 24 in the resulting recess below the edge of the blanket 22.

The outer clamps 40 are then fitted, as shown with their outer limbs 41 overlying the edge of the blanket 22, and bolted onto the head 24. As the bolts 46 are tightened, the outer clamps 40 push the wedge segments 30 up the taper portion 26 of the head 24 moving them both axially and radially so as to clamp and seal the blanket edge between the outer limbs 41 and the wedge segments 30. The surfaces of either the wedge segments 30 or the limbs 41, or both, contacting the blanket edge may be provided with teeth or barbs 48 to increase friction between them and the blanket edge. It will be noted that the blanket edge maintains a substantially straight course between the inner and outer clamps 30, 40.

Figure 5:
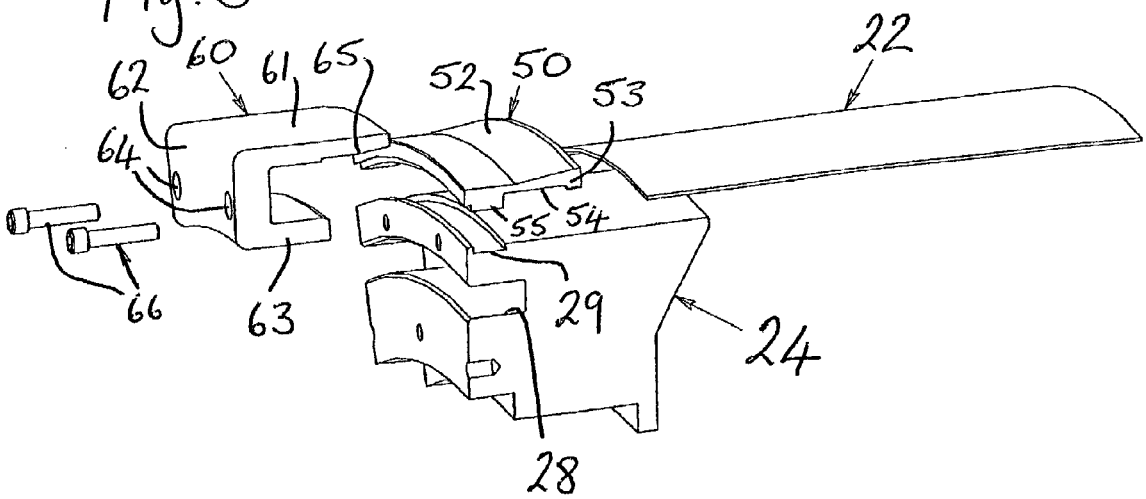
FIG. 5 is an exploded view equivalent to FIG. 2 of a second embodiment of a blanket clamping arrangement for a shoe press in accordance with the present invention.
Figure 6:
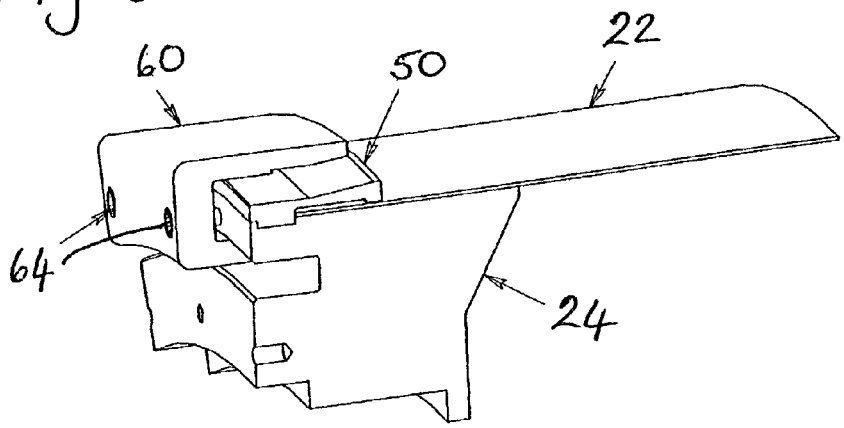
FIG. 6 is a similar view showing the components of FIG. 5 when fitted together.
Figure 7:
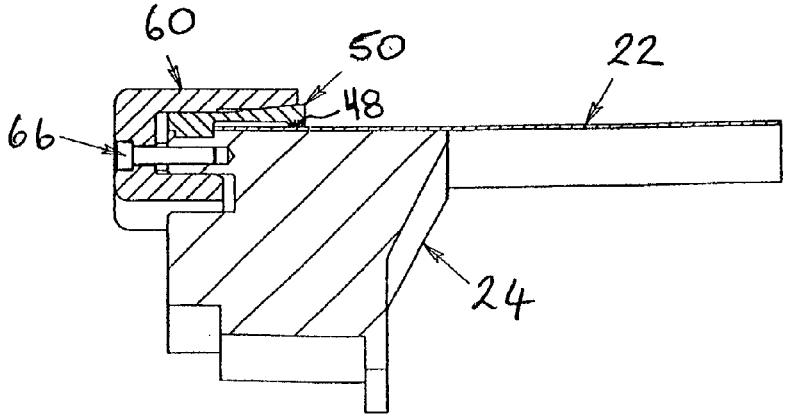
FIG. 7 is a fragmentary cross sectional view of the arrangement of FIGS. 5 and 6.

With reference to FIGS. 5 to 7 of the drawings, a second practical embodiment of the blanket clamping arrangement of the invention similarly comprises eight part-annular wedge segments or inner clamps 50 and four part-annular outer clamps 60, arranged exactly as already described in relation to the first embodiment to form two complete rings of abutting components.

In this embodiment the outer surface of the head 24 is cylindrical (i.e., in contrast to the first embodiment it does not have a frustoconical taper), but it is formed with an annular groove 29. Its end surface, remote from the blanket 22 is again formed with a circular groove 28.

Each wedge segment 50 has an inclined surface portion 52 on its outer surface to mate up with a corresponding tapered surface portion 65 on the outer limb 61 of the outer clamp 60. In other respects the outer clamps 60 are the same as those of the first embodiments having a V-shape in section including a web 62 provided with apertures 64 for bolts 66 and an inner limb 63 to locate into the groove 28.

Each wedge segment 50 is also formed on its inner surface with a lip 53, a shallow recess 54 and a projection 55.

In use, the blanket 22 is passed over the front head as previously described, and positioned relative to the outer head 24, as shown in FIGS. 5 to 7. In this case, its edge margin lies directly upon the cylindrical surface of the head. Again the blanket edge is maintained substantially straight. The wedge segments 50 are then fitted thereover, with their projections 55 engaging in the groove 29 in the head. Thus axial movement of the wedge segments 50 is in this case prevented. The outer clamps 60 are then fitted as shown so that their tapered portions 65 overlie the inclined positions 52 of the wedge segments. As the bolts 66 are tightened the tapered portions 65 ride over the inclined portion 52. This displaces the lip 53 of the wedge segment 50 radially inwards thereby securely clamping and sealing the blanket 22 between the wedge segments 50 and the head 24.

The purpose of the recess 54 in the inner surface of each segment 50 is to allow bending of the wedge segment as well as to form the lip 53.

Teeth or barbs 48 may be provided on the inner surface of the inner clamps (wedge segments) 50, i.e., on the lips 53, to improve the gripping force on the blanket edge.

The foregoing are only illustrative of the scope of the invention. Variations and modified embodiments are possible. In particular the numbers of inner and outer clamps and their exact fitting arrangement may vary in other embodiments. Although the same blanket clamping arrangement is preferable at both ends, i.e., in respect of both heads, it may be that an arrangement in accordance with the invention is only provided at one end.

I claim:

1. A shoe press for a papermaking machine comprising:

a rotatably mounted backing roll, an elongate concave shoe, the shoe being urged toward the backing roll to define an extended nip therebetween for the passage therethrough of a paper web;

a blanket defining an endless loop, wherein the blanket extends through the nip such that the web is disposed between the blanket and the backing roll, the blanket having a first lateral edge and a second lateral edge spaced in the cross machine direction from the first lateral edge;

and a blanket clamping arrangement comprising:

at least one head mounted for rotation about an axis with respect to the shoe;

a plurality of wedge segments arranged radially outwards of the head and each having an inclined surface facing the head, the head also being provided with a frusto-conical wedge surface in engagement with the respective inclined surfaces of the wedge segments; and clamping means mounted onto the head solely from the end thereof remote from the blanket and being axially displaceable relative to the head so as to cause axial and radial displacement of the wedge segments relative to the head, in which respect a lateral edge margin of the blanket extends between the wedge segments and an opposing surface of the clamping means and is clampable therebetween upon radial displacement of the wedge segments;

whereby axial displacement of the clamping means relative to the head causes the blanket selectively to be clamped between the wedge segments and the clamping means, or to be released and removable therefrom.

2. The shoe press according to claim 1 wherein the head is provided with at least one groove in its end remote from the blanket into which a portion of the clamping means locates.

3. The shoe press according to claim 1 wherein the clamping means comprises a plurality of outer clamps.

4. The shoe press according to claim 3 wherein at least some of the outer clamps extend circumferentially to overlap adjacent wedge segments.

5. The shoe press according to claim 3 wherein there are twice as many outer clamps as wedge segments.

6. The shoe press according to claim 3 wherein each outer clamp is mounted to the head in an axially displaceable manner by means of a plurality of bolts.

7. The shoe press according to claim 1 wherein teeth are provided on surfaces of the wedge segments facing the clamping means.

8. The shoe press according to claim 1 wherein teeth are provided on surfaces of the clamping means facing the wedge segments.

9. A shoe press for a papermaking machine comprising:

a rotatably mounted backing roll;

an elongate concave shoe, the shoe being urged toward the backing roll to define an extended nip therebetween for the passage therethrough of a paper web;

a blanket defining an endless loop, wherein the blanket extends through the nip such that the web is disposed between the blanket and the backing roll, the blanket having a first lateral edge and a second lateral edge spaced in the cross machine direction from the first lateral edge;

and a blanket clamping arrangement comprising:

at least one head mounted for rotation about an axis with respect to the shoe;

a plurality of wedge segments arranged radially outwards of the head and each having an inclined surface remote from the head; and clamping means mounted onto the head solely from the end thereof remote from the blanket and being axially displaceable relative to the head so as to cause radial displacement of the wedge segments relative to the head, in which respect the wedge segments and the head have mutually engaging recess and projection formations which prevent axial displacement of the wedge segments relative to the head upon axial displacement of the clamping means relative to the head, the clamping means is provided with a tapered surface in engagement with respective inclined surfaces of the wedge segments, and a lateral edge margin of the blanket extends between the wedge segments and an opposing surface of the head and is clampable therebetween upon radial displacement of the wedge segments.

10. The shoe press according to claim 9 wherein the head is provided with at least one groove in its end remote from the blanket into which a portion of the clamping means locates.

11. The shoe press according to claim 9 wherein the clamping means comprises a plurality of outer clamps.

12. The shoe press according to claim 11 wherein at least some of the outer clamps extend circumferentially to overlap adjacent wedge segments.

13. The shoe press according to claim 11 wherein there are twice as many outer clamps as wedge segments.

14. The shoe press according to claim 11 wherein each outer clamp is mounted to the head in an axially displaceable manner by means of a plurality of bolts.

15. The shoe press according to claim 9 wherein teeth are provided on surfaces of the wedge segments facing the blanket.

* * * * *